United States Patent [19]

Feeley

[11] Patent Number: 4,574,697

[45] Date of Patent: Mar. 11, 1986

[54] SHEET MATERIAL FOR MOUNTING PRINTING PLATES

[75] Inventor: George F. Feeley, Downington, Pa.

[73] Assignee: Norwood Industries, Inc., Malvern, Pa.

[21] Appl. No.: 425,666

[22] Filed: Sep. 28, 1982

Related U.S. Application Data

[63] Continuation of Ser. No. 176,662, Aug. 11, 1980, abandoned.

[51] Int. Cl.[4] ..... B41N 1/12

[52] U.S. Cl. ..... 101/401.1; 101/395; 428/909

[58] Field of Search ..... 101/401.1, 395; 428/909

[56] References Cited

U.S. PATENT DOCUMENTS

| | | | |
|---|---|---|---|
| 3,085,507 | 4/1963 | Kunetka | 101/401.1 |
| 3,128,700 | 4/1964 | Kunetka | 101/401.1 |
| 3,649,439 | 3/1972 | Ross | 101/401.1 |
| 3,652,376 | 3/1972 | Bowden | 428/909 |
| 3,663,289 | 5/1972 | Newman | 101/401.1 |
| 3,705,072 | 12/1972 | Rosvold | 101/401.1 |
| 3,903,794 | 9/1975 | Grupe | 101/401.1 |
| 3,983,287 | 9/1976 | Goossen | 101/401.1 |
| 4,136,615 | 1/1979 | Pozniak | 101/401.1 |

FOREIGN PATENT DOCUMENTS

| | | | |
|---|---|---|---|
| 406187 | 3/1967 | Australia | 101/401.1 |
| 2244765 | 3/1974 | Fed. Rep. of Germany | 101/401.1 |

*Primary Examiner*—Clyde I. Coughenour

*Attorney, Agent, or Firm*—Webb, Burden, Robinson & Webb

[57] ABSTRACT

A sheet material for mounting flexible printing plates to the drum of a printing press includes a base film, a flexible foam uniformly coated on the base film, and a pressure sensitive adhesive coated on both the base film and the foam. The cohesion of the base film and the foam, the adhesion of the base film to the foam, and the adhesion of the adhesive to the base film and the foam is greater than the adhesion of the adhesive to the flexible printing plate and to the drum of a printing press. When the sheet material is removed from the printing plate and the drum, the foam, the base film, and the adhesive remain an integral sheet. A method for preparing and using the sheet material is also disclosed.

13 Claims, 2 Drawing Figures

SHEET MATERIAL FOR MOUNTING PRINTING PLATES

This application is a continuation of application Ser. No. 176,662, filed Aug. 11, 1980 now abandoned.

BACKGROUND OF THE INVENTION

1. Field of the Invention

This invention relates to the mounting of flexible printing plates and more particularly to pressure sensitive adhesive sheet materials for mounting such printing plates.

2. Description of the Prior Art

"Flexographic" printing involves a flexible printing plate mounted to the drum of a printing press. "Drum" as used herein, refers to removable sleeves, cylinders and the like upon which the printing plate is mounted. The flexible printing plates are formed of molded compressible rubber with the particular design to be printed being defined by the highest portions of the printing plate.

The dimensional manufacturing tolerances for the flexographic pringting plates must be closely controlled in order to produce printed images free of low spots and other imperfections. In operation, the printing plate is mounted to the press drum and the press rolls are adjusted to provide the proper pressure for ink transfer to the plate, and ink transfer from the plate to the substrate to be printed. It is desirable to make as few adjustments as possible throughout a printing run.

A critical link in the flexographic printing apparatus is the adhesion of the printing plate to the press drum. The adhesive material used should be easily handled, should not affect the printing process and should be easily removed.

One technique for adhering the printing plate to the press drum is by applying a liquid or semi-solid adhesive to the drum or plate and placing the drum and plate in mating engagement. After use, the adhesive must be peeled from the plate and/or drum in pieces because the cohesion of the adhesive is less than the adhesion of the adhesive to the printing plate and/or the drum. Removal of the adhesive is a time-consuming process.

It has, therefore, been proposed to use pressure sensitive adhesive coated sheet materials which are easily applied to both the printing plate and the press drum. The sheet materials have been fabricated from vinyl sheet coated with a pressure sensitive adhesive on both sides. Although the vinyl has adequate integrity to be removed from the drum and/or plate and remain integral, the vinyl does not retain the same gauge throughout a long print run because of lack of memory, and undesirable adjustments must be made to the press over the course of printing to provide a quality printed product.

Another proposed pressure sensitive sheet material has been flexible foam coated on both sides with a pressure sensitive adhesive. Although the foam has desirable properties with respect to memory, it does not have sufficient integrity to remain as an integral sheet when it is delaminated from the printing plate and/or press drum, and thus has deficiencies similar to liquid or semi-solid adhesives applied directly to the drum.

A further problem associated with the adherence of flexible printing plates to printing drums is that the particular adhesive selected must have adhesive properties to various rubber or plastic printing plates and to press drums of various metal compositions. In some instances, it has been proposed to use a sheet material which has different adhesives coated on opposing sides in order to provide adhesion to the plate on one side and the press drum on the opposing side.

In accordance with the present invention, a sheet material for mounting flexible printing plates to the drum of a printing press is provided which has a uniform gauge and maintains this gauge during the printing process. Further, the sheet material in accordance with the invention preferably uses the same adhesive on both sides of the sheet material.

In addition, the sheet material of the present invention has sufficient integrity so that it remains an integral sheet upon removal from the drum and press.

BRIEF DESCRIPTION OF THE INVENTION

A sheet material for mounting flexible printing plates to the drum of a printing press includes a base film, a flexible foam uniformly coated on the base film, and a pressure sensitive adhesive coated on both the base film and the foam. The cohesion of the base film and the foam, the adhesion of the base film to the foam, and the adhesion of the adhesive to the base film and the foam is greater than the adhesion of the adhesive to the flexible printing plate and the drum of the printing press. When the sheet material is removed from the printing plate and the drum, the foam, the base film and the adhesive remain an integral sheet. A method for preparing and using the sheet material is also disclosed.

DETAILED DESCRIPTION OF THE INVENTION

The base film useful in the practice of the invention is a film having a thickness of 1 to 20 mils and may be plastic or metal. The primary criteria for the film is tear resistance, flexibility, and dimensional stability during fabrication of the sheet material and use of the sheet material during the printing process. Most preferably, the base film is constructed of biaxially oriented polyethylene terephthalate sold under the trade name Mylar. Thermoplastic polymers having polyethylene terephthalate units along with other polyester moieties may also be used so long as they have similar tear resistance, flexibility, and dimensional stability. When polyethylene terephthalate is used for the base film it has a gauge of about 1 to 5 mils and preferably 2 to 3 mils.

The flexible foam useful in the practice of the invention is one which has a resilience of greater than 40 percent according to ASTM D 2632-74 and has a density of greater than 30 lb./ft.$^3$ and preferably between 35 and 60 lb./ft.$^3$ and most preferably between 35 and 40 lb./ft.$^3$.

The flexible foam is preferably formed of a polyurethane produced by reacting a polyol with a polyisocyanate. The polyisocyanates useful in the practice of the invention are the aromatic, aliphatic and cycloaliphatic diisocyanates or mixtures thereof and which are capable of reacting with hydroxyl groups. Such isocyanates, for example, are toluylene-2, 4-diisocyanate; toluylene-2, 6-diisocyanate; meta-phenylene diisocyanate; biphenylene-4, 4'-diisocyanate; methylene-bis (4-phenyl isocyanate); 4-chloro-1, 3-phenylene diisocyanate; napthylene-1, 5-diisocyanate; tetramethylene-1, 4-diisocyanate; hexamethylene-1, 6-diisocyanate; decamethylene-1, 10-diisocyanate; cyclohexylene-1, 4-diisocyanate; methylene-bis (4-cyclohexyl isocyanate); tetrahydronapthylene diisocyanate; isophorone diisocyanate and the like.

The isocyanates may be used in purified or crude form and may include dimers of the individual diisocyanates previously recited, particularly in the case of methylene-bis (4-phenyl isocyanate).

The polyols useful in the practice of the invention are those polyols having a functionality of two or more and are capable of reaction with isocyanate groups. Difunctional polyols are typically monomeric diols, polyalkylene ether or polyester diols, including oxyalkylated amines. Exemplary of the polyether diols are, but not limited to, polyethylene ether glycol, polypropylene ether glycol, polytetramethylene ether glycol, polyhexamethylene ether glycol, polyoctamethylene ether glycol, polydecamethylene ether glycol, polydodecamethylene ether glycol and mixtures thereof. Diols containing several different radicals in the molecular chain, such as, for example, the compound $HO(CH_2OC_2H_4O)_nH$ wherein n is an integer greater than one, can also be used.

The polyol may also be a hydroxy terminated or hydroxy pendant polyester which can be used instead of or in combination with polyalkylene ether glycols. Exemplary of such polyesters are those formed by reacting acids, esters or acid halides with diols. Suitable diols are poly (methylene) glycols such as ethylene, propylene tetramethylene or decamethylene glycol; substituted methylene diols such as 2, 2-dimethyl-1, 3-propane diol, cyclic glycols such as cyclohexanediol and aromatic diols. Aliphatic diols are preferred in the practice of the invention since flexibility is desired. These aliphatic diols may be reacted with aliphatic, cycloaliphatic or aromatic dicarboxylic acids or lower alkyl esters or ester forming derivatives to produce relatively low molecular weight polymers, preferably having a melting point of less than about 70° C. and a molecular weight like those indicated for the polyalkylene ether glycols. Acids for preparing such polyesters are, for example, phthalic, maleic, succinic, adipic, suberic, sebacic, terephthalic and hexahydrophthalic acids and the alkyl and halogen substituted derivatives of these acids. In addition, polycaprolactones terminated with hydroxyl groups may also be used. The polyols useful in the practice of the invention are those also having a functionality of greater than two which are, or are based upon, trifunctional or tetrafunctional monomeric polyhydroxy compounds such as glycerol, trimethylolpropane, pentaerythritol, trimethylolethane and the like. These monomeric materials having a functionality of greater than two can be chain extended while maintaining the same functionality per molecule by the use of alkylene oxides to produce hydroxy alkyl terminated triols and tetrols of moderate to high molecular weight.

The monomeric diols useful in the practice of the invention are typically, ethylene glycol, propylene glycol, tetramethylene glycol, decamethylene glycol and the like. Mixtures of the polyols previously recited may also be used.

In preparing the foam useful in the practice of the invention, catalysts in art-recognized quantities may be used. Typical catalysts are the polyamine catalysts and more preferably the tin catalysts such as dibutyltin dilaurate, stannous octoate and the like.

Known dyes, pigments and fillers may also be added. The fillers are used in levels of up to 50 percent by weight. Typical fillers useful in the practice of the invention are inorganic fillers such as silica, calcium carbonate and the like.

The flexible foam useful in the practice of the invention has a density of preferably greater than 30 pounds per cubic foot and more preferably between 35 and 40 pounds per cubic foot. Although known chemical and gaseous blowing agents may be used to form the foams, it is preferably that the foams be mechanically frothed. The foam so produced is extremely flexible and has excellent adhesion to the base film to form an integral sheet. The foam layer is between 10 and 20 mils thick and more preferably between 10 and 15 mils thick.

The coating of the foam to the base film is more fully disclosed in U.S. Pat. No. 3,941,633, incorporated herein by reference.

It is important in forming the sheet material of the invention that the foam be coated to as to form a uniform thickness with preferably a deviation of less than 2 mils and more preferably less than 1 mil across the sheet material. The foam has the resilience greater than 40 percent resilience in order to provide the necessary resilience for continued use as a flexographic printing plate mounting material.

On both the exposed foam side and exposed film side of the material, a pressure sensitive adhesive is coated. The pressure sensitive adhesive is coated at a thickness sufficient to provide a peel strength greater than 32, more preferably greater than 40, and most preferably between 40 and 55 according to the Pressure Sensitive Tape Council Test Method PSTC-3 when tested on stainless steel and rubber. Although pressure sensitive adhesives useful in the practice of the invention can be those which are recognized in the art as useful for such purposes, it has been found that the most preferred pressure sensitive adhesives are the rubber based adhesives based upon natural or synthetic rubber and preferably including a phenolic resin and more specifically a resorcinol formaldehyde resin. These adhesives are well known to those skilled in the art.

The rubber based adhesive is coated on the foam side and the film side at a thickness of up to 3 mils. Preferably, the rubber based adhesive is coated on the base film side at a thickness less than on the foam side. The increased thickness on the foam side is due to both the porous nature of the foam and the slightly irregular rheology of the foam surface. Typically, on the base film side the adhesive is present at a thickness of greater than 0.5 mil and preferably between 1.0 and 2.0 mils, whereas on the foam side the adhesive is at a thickness of at least 1.0 mil.

Optionally and most preferably, a primer is applied to the foam side of the sheet material prior to coating with the adhesive. This primer is typically a natural or synthetic rubber based adhesive which contains an antioxidant in a strong aromatic solvent. In addition to the aromatic solvent, the primer coat utilizes a highly polar, volatile solvent such as methyl ethyl ketone, acetone or the like. It is hypothesized that the highly polar solvent attacks the surface of the foam to provide a strong adhesive bond between the foam and the subsequently coated pressure sensitive adhesive material.

In preparing sheet material in accordance with the invention, the two components of the urethane foam system are preferably mechanically frothed and cast on the base film according to the knife over roll method described in U.S. Pat. No. 3,941,633. The prime coat (if used) is cast on the foam side of the integral base film/foam composite and this intermediate product is wound on a roll. The rubber based adhesive is coated to provide the desired dry mil thickness on one side of a release paper and the adhesive coated side of the release paper is mated to the previously formed roll on the foam side, thus coating the foam side with the pressure sensitive adhesive material. The base film side of the second intermediate composite is then coated with an adhesive to provide the desired film thickness and the material is dried. The release paper is removed and a polyethylene release sheet is engaged with the adhesive on the foam side and the product is wound into a roll.

In using the sheet material for mounting flexographic printing plates, several methods particularly adapted to individual printer's techniques may be used. It has been found that the sheet material prepared in accordance with the invention has excellent adhesion to both print rolls, sleeves and flexographic plates and can be adhered to each on either side of the print mounting material. One method of using the printing plate mounting material of the invention is to unroll a portion of the material and cut it to the shape of the flexographic plate on the base film side. The polyethylene release film can then be stripped off and mounted to the metal sleeve or the drum of a printing press. It is desirable to seal the edges with known liquid sealing compounds to prevent the strong solvents in printing inks from penetrating between the printing plate, sheet material and drum or sleeve structure. In an alternate method, the sheet material can be unwound and mounted to the drum of a printing press with the adhesive coated foam side on the roll. The polyethylene release film can then be stripped off and the printing plate mounted thereon. A third and very common method of using the tape in accordance with the invention is to unroll the sheet material and mount it on a sleeve which is to be subsequently mounted on the drum of a printing press. The polyethylene release film is then stripped off and the printing plate mounted thereon. The sleeve may then be stored for long periods of time and used intermittently when desired by the printer. During storage, the assembled sleeve does not deteriorate by way of the printing plate delaminating from the sleeve by failure of the mounting material.

One particular advantage of the invention is that the elastomeric foam has sufficient density and resilience so that once the printing plate is mounted on the sleeve or drum and the press is set to provide the desired pressure for printing, the press needs very little, if any, pressure adjustment even through long runs, since the gauge of the mounting material remains constant during the printing process.

The following drawings will more fully illustrate the product prepared in accordance with the invention along with the use of the sheet material for mounting flexographic printing plates.

DETAILED DESCRIPTION OF THE DRAWINGS

Figure 1:
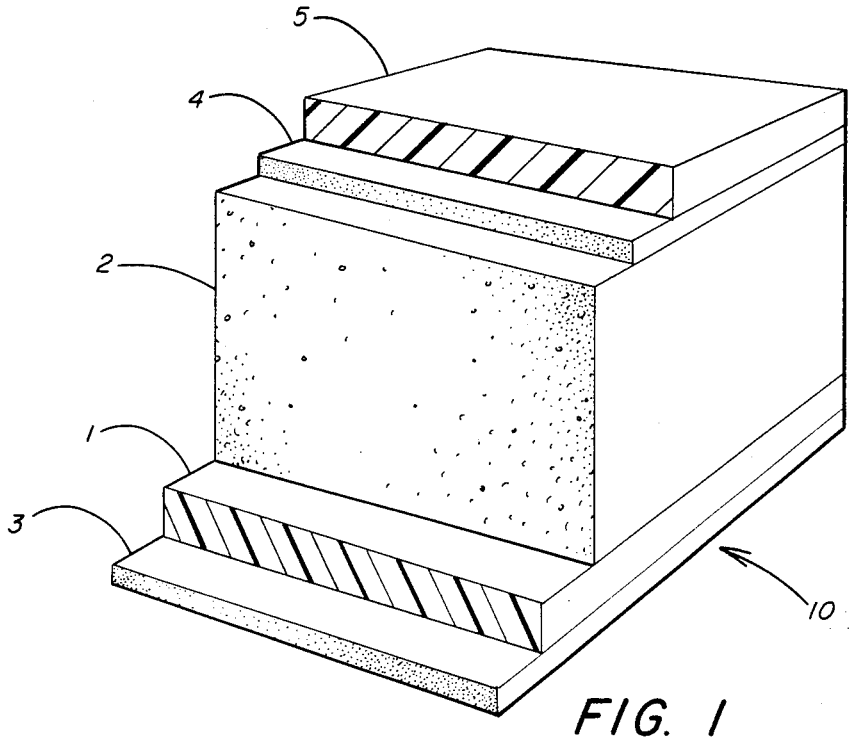
FIG. 1 is an enlarged perspective view in partial layers of a portion of the mounting material prepared in accordance with the invention.

Referring now to FIG. 1, there is shown a base film 1 coated with the elastomeric foam 2. In accordance with the preferred embodiment, a primer coat 4 is coated on the foam in order to provide a strong bond between the foam 2 and the subsequently applied adhesive layer 5. A pressure sensitive adhesive layer 3 is coated on the base film 1. Preferably, the adhesive layers 3 and 5 are of the same chemical composition, but having different thickness, the greater thickness being on the foam side.

Figure 2:
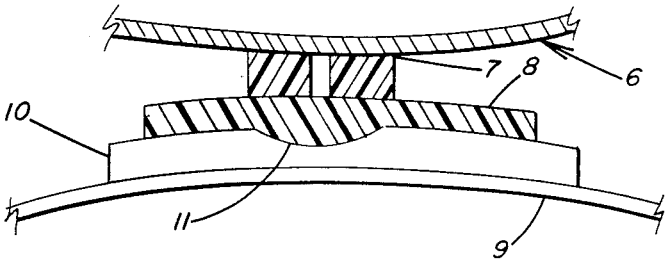
FIG. 2 is a cross-sectional view of the material mounted on a printing press and in use during the printing process.

Referring now to FIG. 2, there is shown a printing surface 6 such as paper or the like in contact with the raised portions of the printing plate, i.e. the contact surface 7. The integral base of the printing plate 8 is mounted to the printing cylinder 9 by way of the print mounting material of the invention 10.

As is shown in the drawing during the printing process, the pressure required to transfer the printing media such as ink from the surface of the plate 7 to the printing surface 6 requires a certain amount of pressure. This pressure causes the foam of the mounting tape to depress such as is shown at 11, and due to both the density and the resilience of the sheet material, it immediately rebounds to its original gauge.

After the printing process is completed and a particular plate is to be removed from a sleeve or a drum, the printing plate is pulled from the drum and the plate mounting material adheres as an integral sheet to either the cylinder or the plate. The mounting material is then stripped from the plate or drum as an integral sheet with little or no transfer of the adhesive and no delamination or severing of the sheet material.

The following example is illustrative of the various materials and techniques used in the process of the invention.

EXAMPLE I

A 2 mil polyethylene terephthalate (Mylar) biaxially stretched base film was coated by knife over roll with a mechanically frothed polyurethane elastomeric foam prepared in an Oaks Mechanical Foaming machine. The knife over roll coating method is more fully disclosed in U.S. Pat. No. 3,941,633. The foam constituents were as follows:

| Ingredient | Quantity (Parts by Weight) |
|---|---|
| Polycaprolactone diol (molecular weight 200 Union Carbide PCP-0200) | 19 |
| Polycaprolactone (molecular weight 300 Union Carbide PCP-0300) | 5 |
| Dipropylene glycol | 5 |
| Graft polyether polyol (functionality 2.25) Hydroxyl Number 50 Primary Hydroxyl/ Secondary Hydroxyl 39/61 | 71 |
| Methylene diisocyanate having an NCO content of 22.6 ± 0.6% | 127 |
| Calcium carbonate | 250 |
| Black dye | 15 |
| Tin catalysts | 2.5 |

The foam was coated at a thickness of approximately 15 mils. The foam was cured and a primer coat was applied to the foam side of the intermediate. The primer was composed of a 70 percent solid synthetic rubber based adhesive in toluene sold under the trade name PA 451 by Precision Adhesives along with 30 parts of methyl ethyl ketone. The primer coat was applied at a level of 0.079 pounds per yard$^2$. A rubber based adhesive having a percent solids of 40%, a quick stick of 37 oz./in., and a 90° peel value of 41 oz./in. sold by All Adhesives and Chemicals, Inc. under No. 4960 was coated on release paper at a dry film thickness of 1.5 to 1.8 mils, and the adhesive was then laminated to the foam side of the first intermediate. The Mylar side of the composite was then coated with 1.3 to 1.5 dry mils of the same adhesive. After coating, the release paper was removed and a polyethylene release sheet was placed upon the foam side of the product and the material was wound on a roll. The roll was 54 inches wide and was useful in mounting flexographic printing plates.

Although the invention has been described with reference to specific materials and specific processes, the invention is not to be limited only so far as is set forth in the accompanying claims.

I claim:

1. A sheet material for mounting flexible printing plates to the drum of a printing press comprising:

a base film having a gauge of 1 to 5 mils;

a flexible foam at a thickness of 10 to 20 mils uniformly coated on and adhered to said base film, said foam having at least 40 percent resilience according to ASTM D 2632-74;

a pressure sensitive adhesive coated on said base film and said foam; and the cohesion of said base film and said foam, the adhesion of said base film to said foam, and the adhesion of said adhesive to the base film and said foam being greater than the adhesion of the adhesive to the flexible printing plate and the drum of a printing press; whereby when the sheet material is removed from the printing plate and the drum, the foam, the base film and the adhesive remain an integral sheet.

2. The sheet material of claim 1 wherein said base film is biaxially oriented polyethylene terephthalate.

3. The sheet material of claim 1 wherein said base film has a gauge of 2 to 3 mils.

4. The sheet material of claim 1 wherein said flexible foam is a polyurethane foam.

5. The sheet material of claim 1 wherein said flexible foam had a density of greater than 30 lbs./ft.$^3$.

6. The sheet material of claim 5 wherein said flexible foam has a density of 35 to 60 lbs./ft.$^3$.

7. The sheet material of claim 6 wherein said flexible foam has a density of 35 to 40 lbs./ft.$^3$.

8. The sheet material of claim 1 wherein said foam has a thickness of 10 to 15 mils.

9. The sheet material of claim 1 wherein the pressure sensitive adhesive is a rubber based adhesive.

10. The sheet material of claim 1 wherein said adhesive is coated at a sufficient thickness to provide a peel strength of greater than 32 oz. according to Method PSTC-3.

11. The sheet material of claim 10 wherein said rubber based adhesive is coated at a sufficient thickness to provide a peel strength of greater than 40 oz.

12. The sheet material of claim 1 wherein the adhesive is coated at a thickness of up to 3 mils.

13. The sheet material of claim 1 including a primer between said foam and said adhesive to increase the adhesion of said foam to said adhesive.

* * * * *